US007658368B2

(12) United States Patent
Laun

(10) Patent No.: US 7,658,368 B2
(45) Date of Patent: Feb. 9, 2010

(54) NAIL EXTRACTOR

(76) Inventor: Craig M. Laun, 8557 Lesourdsvukke-West Chester Rd., West Chester, OH (US) 45069

( * ) Notice: Subject to any disclaimer, the term of this patent is extended or adjusted under 35 U.S.C. 154(b) by 0 days.

(21) Appl. No.: 12/231,519

(22) Filed: Sep. 3, 2008

(65) Prior Publication Data

US 2009/0236572 A1 Sep. 24, 2009

Related U.S. Application Data

(60) Provisional application No. 60/994,835, filed on Sep. 21, 2007.

(51) Int. Cl.
*B25C 11/00* (2006.01)

(52) U.S. Cl. ..... 254/18; 29/255; 29/263; 29/270

(58) Field of Classification Search ..... 254/18, 254/29 R, 30, 31, 10.5; 29/255, 263, 270, 29/278

See application file for complete search history.

(56) References Cited

U.S. PATENT DOCUMENTS 2,533,112 A * 12/1950 Hayden ..... 227/63
2,797,889 A * 7/1957 Talboys ..... 254/18
3,735,650 A * 5/1973 Weng, Jr. ..... 81/53.2
6,526,641 B1 * 3/2003 Latham ..... 29/239
6,910,252 B2 * 6/2005 Draggie et al. ..... 29/263
7,140,087 B1 * 11/2006 Giltner ..... 29/426.1
2009/0236572 A1 * 9/2009 Laun ..... 254/18

* cited by examiner

*Primary Examiner*—Lee D Wilson
(74) *Attorney, Agent, or Firm*—Neal O. Willmann

(57) ABSTRACT

Disclosed and described herein is a nail extractor adapted for the powered extraction of partially exposed headed-nails from a substrate. The extractor has a housing with a threaded opening for the fitment of a threaded spindle having a hexagonally-shaped proximal end for the attachment of a power tool and a claw assembly attached to the distal end of the spindle so as to permit free rotation of the spindle while the claw assembly is confined and sized to prevent turning within the housing. Additionally, the claw assembly has a cleft for engaging and grasping the partially exposed portion of the headed nail. When activated by the powered tool, the threaded spindle and claw assembly are vertically elevated within the housing and the partially exposed nail is extracted from the substrate.

2 Claims, 3 Drawing Sheets

NAIL EXTRACTOR

CROSS-REFERENCE TO RELATED APPLICATION

This application claims the benefit of the filing date of U.S. Provisional Application 60/994,835 filed Sep. 21, 2007.

BACKGROUND OF THE INVENTION

The invention disclosed and claimed herein relates generally to a nail extraction device and its method of use. More specifically, it relates to a device for the extraction of headed nails that are partially exposed, meaning that the nails have the head and at least a portion of the nail shank exposed for gripping by the claw of the device. Even more specifically, the invention disclosed herein relates to a device having a claw assembly attached to a threaded spindle that can be turned or rotated by a power tool to remove a partially exposed nail from a substrate. The extraction device described herein, when appropriately powered, replaces crowbars, prybars and claw hammers and minimizes the effort and tedium involved in removing large numbers of nails from reusable substrates, typically lumber.

DESCRIPTION OF THE PRIOR ART

The state of the art with regard to powered nail extractors is replete with gadgets and devices that promise to solve the vexing problem of easily, safely and quickly extracting embedded yet partially exposed nails from substrates. Most of the devices of the prior art are over-engineered, unwieldy and expensive to acquire. Representative examples of relevant prior art devices include the following:

U.S. Pat. No. 4,482,131, which issued to Hamilton on Nov. 13, 1984 describes a Nail Extractor device for removing nails from boards wherein the device includes an elongated rod adapted to drive a nail extractor head having a groove shaped to grip nails embedded in a board. When a nail head is fully engaged within the groove, a powered impact wrench is employed to turn the elongated rod rolling the nail extractor to the side and lifting the engaged nail from the board.

U.S. Pat. No. 6,755,392, which issued to Phillips on Jun. 29, 2004 describes a Nail Extractor employing a smooth walled tube having an inside diameter slightly larger than the diameter of the heads of nails to be removed. The tube is spun and pressed into the wood around the nail head so that the tube drills into the wood and compresses a core of drilled wood against the embedded nail. When the tube has been spun and pressed into the wood to a sufficient depth, the compressed wood inside the tube grips and spins the nail loose so that the nail is extracted from the wood.

U.S. Pat. No. 4,007,913, which issued to Aldrich on Feb. 15, 1977 describes a hand-held Nail Puller having nail gripping jaws mounted for linear movement and coupled to a rotary, threaded drive cylinder that is rotatably driven by a linearly reciprocal plunger to linearly move the jaws and extract a nail gripped by the jaws.

SUMMARY OF THE INVENTION

Notwithstanding the cleverness and relevance of the foregoing extraction devices, the instantly disclosed and claimed device has elements that are uniquely structured and deployed to quickly and effectively extract partially exposed headed-nails from a substrate. Specifically, the nail extractor described herein comprises a housing having elongated sides, a top having a threaded opening, an open bottom, and a port, in a portion of said sides, contiguous with the open bottom. Additionally, the disclosed extractor has a spindle, predominately threaded, having a distal end and a hexagonally-shaped proximal end. The spindle is threaded to rotate in the threaded opening in the top of the housing and to move up and down within the housing in accordance with the counter-clockwise or clockwise rotation of the spindle. At the distal end of the threaded spindle is a claw assembly securely but rotatably attached to the spindle. An essential feature of the claw assembly is a claw formed by a cleft in the assembly, and wherein the cleft is capable of engaging with a partially exposed headed nail. The unexposed portion of the nail is typically embedded in a substrate.

When properly deployed, the hexagonally-shaped end of the threaded spindle is inserted and securely held by the chuck of a power tool and the partially exposed nail is fitted within the claw assembly and engaged with the cleft of the claw assembly. The power tool is activated, the threaded spindle and claw assembly are vertically elevated within the housing, and the grasped nail is extracted from the substrate.

DETAILED DESCRIPTION OF THE PREFERRED EMBODIMENTS

Figure 1:
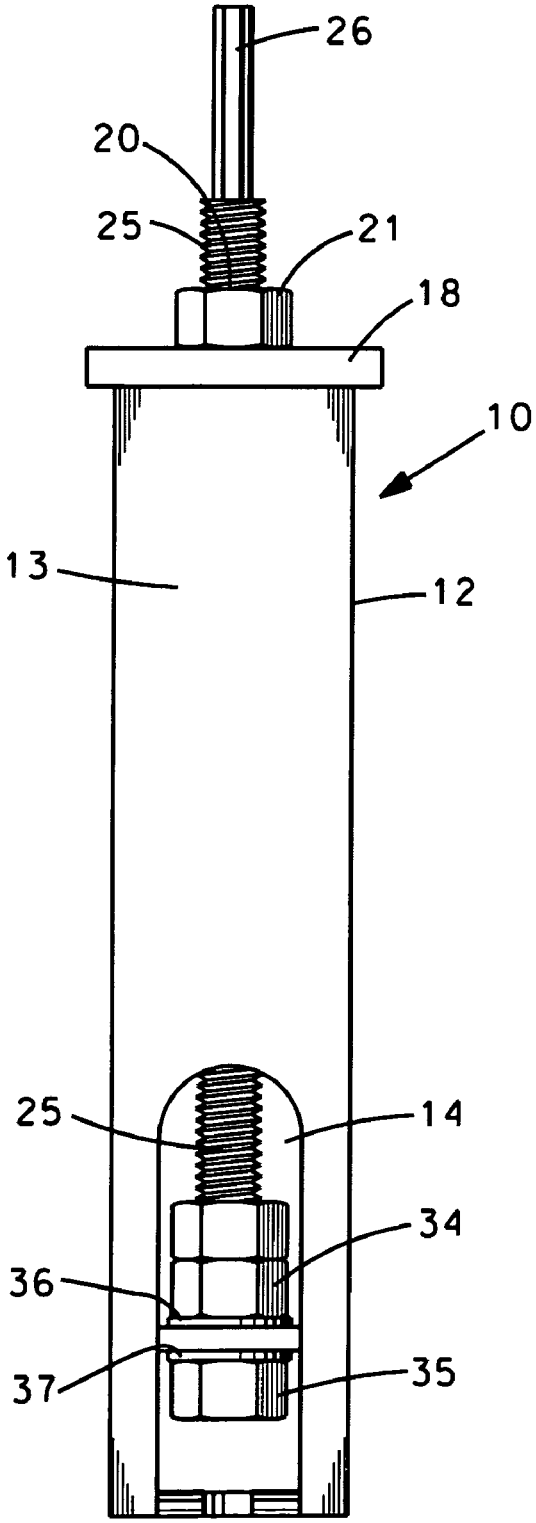
FIG. 1 is an elevated frontal view of the disclosed extractor.
Figure 2:
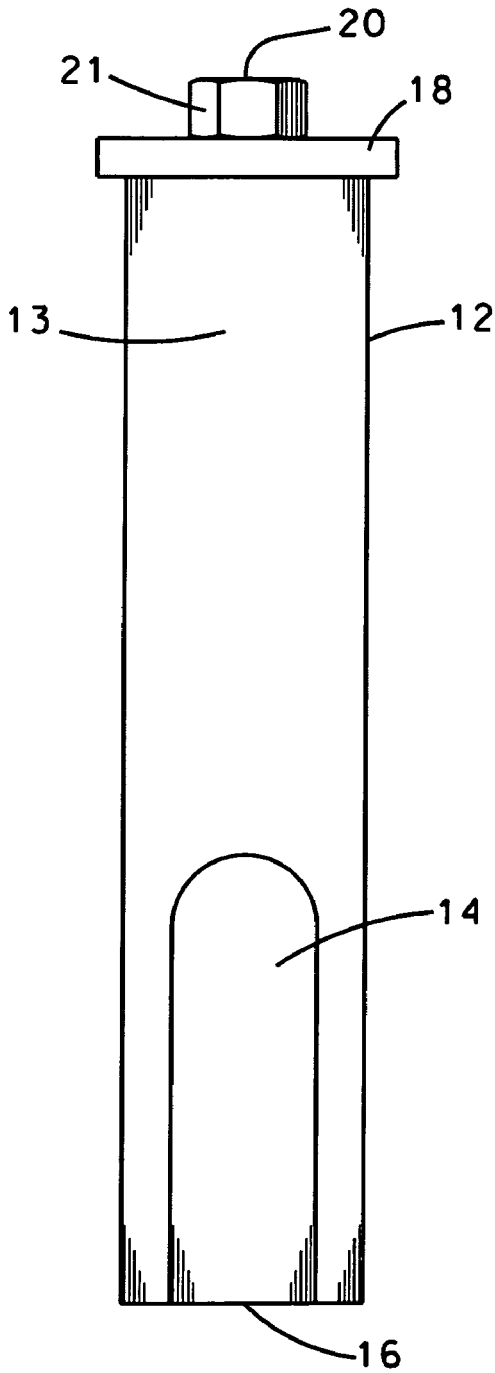
FIG. 2 is an elevated frontal view of the housing of the extractor.
Figure 3:
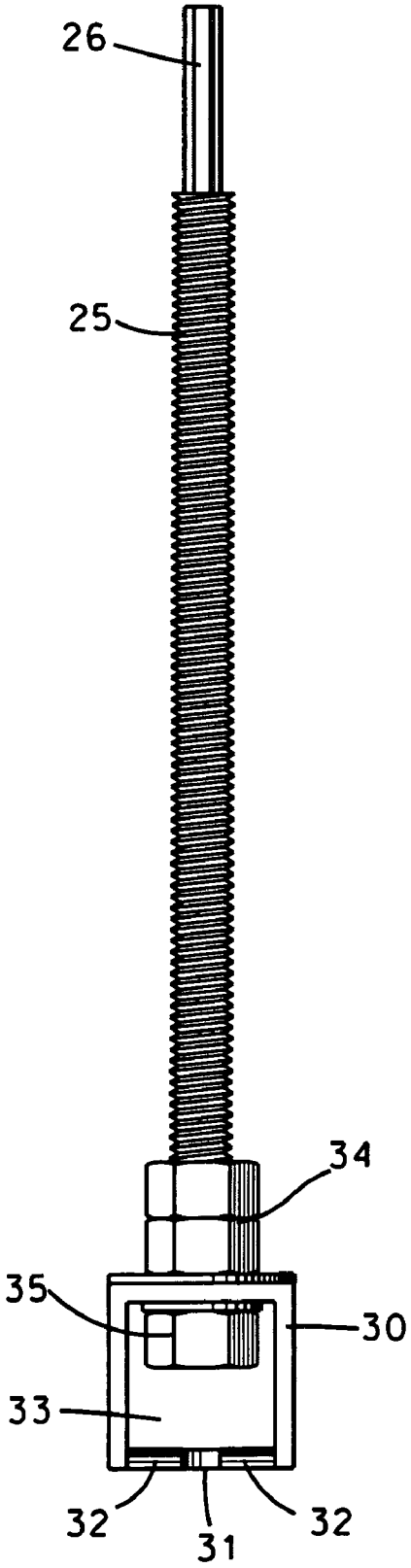
FIG. 3 is an elevated frontal view of the spindle and claw assembly.

A full understanding and appreciation of the disclosed invention and its method of use are facilitated by reference to the drawing. Specifically, FIGS. 1, 2 and 3 illustrate the disclosed extractor 10 and all of its elements. While FIG. 1 depicts the extractor 10 assembled for use, initially referring to FIGS. 2 and 3 will aid in an elaboration of the device.

The device 10 comprises an elongated housing 12 having side walls 13 for support of the threaded spindle 25. The housing 12 also has a top side 18 with a threaded opening 20. The threaded opening, of course is threaded to be compatible with the threads on the threaded spindle 25. To enhance the structure and strength of the threaded opening 20, a threaded dome or nut can be attached to the top 18 of the housing 12 to extend the threaded sides of the opening 20 and strengthen the mechanical relationship between the spindle and the housing.

The housing 12 (FIG. 2) also requires an open bottom 16, which is contiguous with a port 14 in the elongated side or sides 13 of the housing 12. The port and open bottom facilitate placing the extractor 10 on the exposed nail 39 (FIG. 4) to be removed. The port also facilitates access to, and removal of, the extracted nail from the device.

FIG. 3 illustrates the threaded spindle 25. As mentioned, the spindle 25 is threaded to be compatible and mate with the threaded opening 20 and any dome 21 serving to extend threaded support for the spindle. The proximal end of the spindle is machined to offer hexagonal tooling 26 for fitment within the chuck of a powered tool, typically a drill with clockwise and counterclockwise capability. The distal end of the spindle features a claw assembly 30 freely, but securely, attached to the spindle by paired fasteners 34 and 35. So, during the extraction process, the spindle is free to turn within the confines of the housing and through the threaded opening while the claw assembly is prevented from turning by its confinement within the housing of the device. In the preferred embodiment of the device, the free turning of the spindle relative to the claw assembly is facilitated by washers 36 and 37. The claw assembly 30 defines a chamber 33 for the placement of the partially exposed nail, typically the head 41 of the nail and any exposed shank, and a claw 32 formed by cleft 31. The claw needs to be exceptionally durable and therefore should be fabricated of high-strength metal such as forged steel.

In operation the claw assembly needs to be confined within the interior of the housing. Confinement means that the claw assembly 30 is contained within the housing 12 and sized to prevent the assembly 30 from fully rotating to the right or left. While the spindle demonstrates free and complete rotation as it ascends and descends within the confines of the housing and through the threaded opening during the utilization of the device, the claw assembly 30 maintains its orientation within the confines of the housing 12, which serves as a guide for the claw assembly as it ascends during the extraction process.

The size or shape of the walls is not critical to the operation of the device; however, the shape of the housing 12 must be compatible with the claw assembly 30. A compatible housing is large enough to contain the claw assembly and small enough to prevent the claw assembly from freely rotating within the housing. Currently, the preferred housing is angular in shape.

Figure 4:
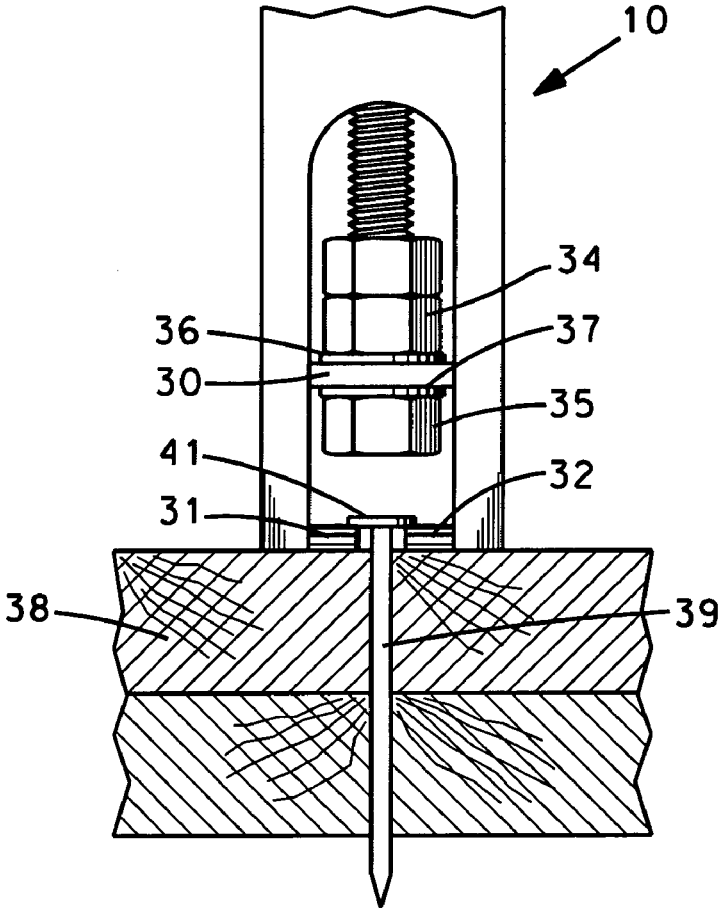
FIGS. 4 and 5 are illustrations of a nail being extracted from a substrate.
Figure 5:
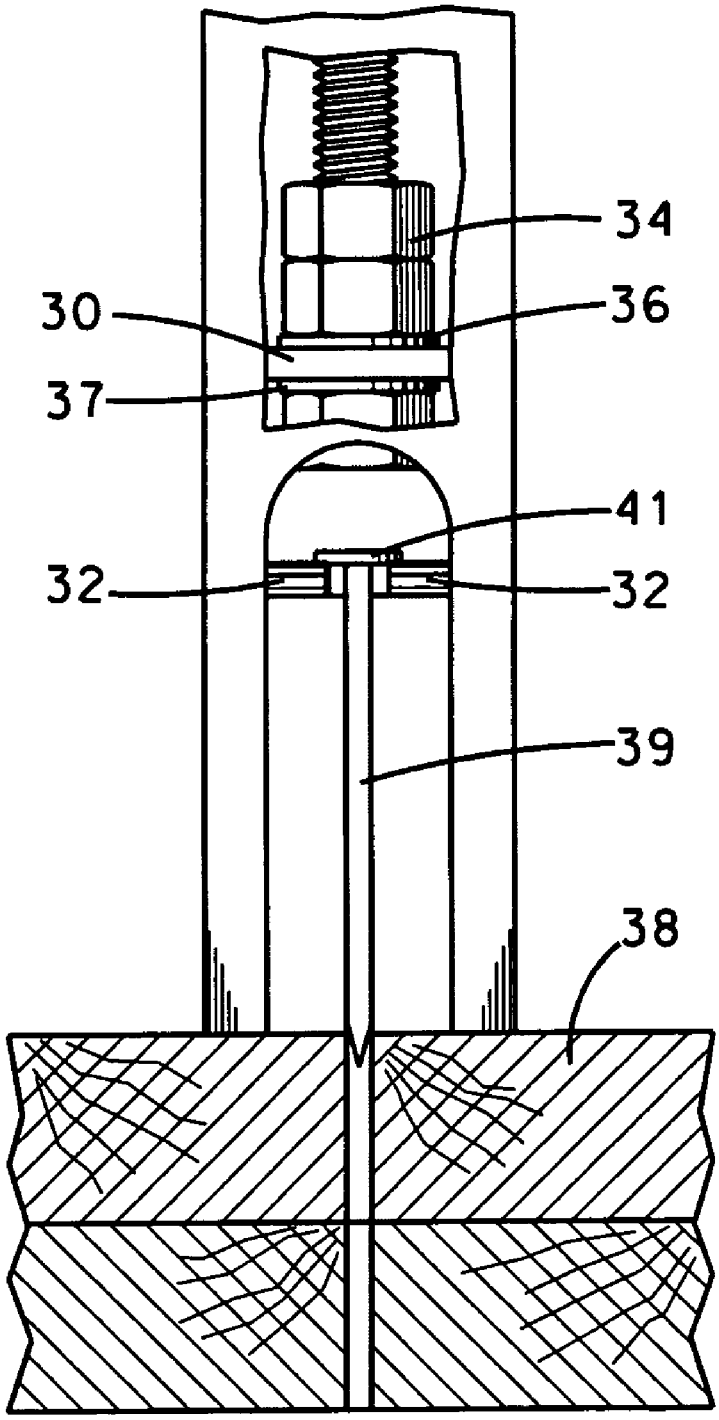

FIGS. 4 and 5 illustrate the proper placement of the extractor 10 for the removal of a partially exposed nail 39 from a substrate 38. The nail and substrate are illustrated in cross-section to enhance the depiction. The nail-head 41 and exposed shank of the nail 39 are manually placed within the cleft 31 of the claw 32 in the claw assembly 30. Placement of the partially exposed nail within the cleft of the claw assembly is facilitated by having a contiguous open bottom 16 and port 14 in the housing 12. After the exposed shaft of the nail 39 is positioned within the confines of the claw chamber 33 and positioned within the cleft 31 of the claw 32, the spindle 25 is activated by the power tool (not shown) to turn counter clockwise within the housing 12 and ascend vertically through the threaded opening in the top of the housing. The ascension of the threaded spindle 25, along with the attached claw housing 30, by rotary screw action, also extracts the embedded nail 39 from the substrate 38.

The disclosed device can be fabricated from a variety of materials, and currently a sturdy metallic device is preferred. There is somewhat more flexibility in the composition of the housing, which can be fabricated from a variety of non-compressible materials. Clearly, the housing needs to afford the structural strength to support the stress placed on the threaded opening during the extraction process.

While the foregoing is a detailed and complete description of the preferred embodiments of the disclosed nail extraction device and its method of use, it should be apparent that numerous variations and modifications can be made and employed to implement the all important purpose of the disclosed device without departing from the spirit of the invention, which is fairly defined by the appended claims.

The invention claimed is:

1. A nail extractor adapted to be actuated by a powered tool said extractor comprising:

a housing having elongated sides which are angular and an interior cavity, a top having a threaded opening, an open bottom, and a port in a portion of said sides said port contiguous with said open bottom;

a spindle, predominately threaded to mate with the threads of said threaded opening so as to descend and ascend within said housing when turned clockwise and counterclockwise, respectively, said spindle having a distal end and a hexagonally-shaped proximal end; and a claw assembly attached to said distal end of said spindle so as to allow said spindle to turn freely while said assembly is prevented from turning by confinement within said housing wherein said claw has a shaped mimicking said angular sides of said housing sized to fit within said housing interior cavity with said claw at least sized to prevent rotation of said claw assembly's said shape, said assembly having a claw formed by a cleft in said assembly said cleft capable of engaging with an exposed nail head and shank of a nail embedded in a substrate thus facilitating extraction of said nail from said substrate when said extractor is actuated by said power tool attached to said hexagonally-shaped end of said threaded spindle.

2. A method of extracting a partially exposed headed nail from a substrate said method comprising the steps of:

a nail extractor adapted to be actuated by a powered tool said extractor comprising a housing having elongated sides, a top having a threaded opening, an open bottom, and a port in a portion of said sides said port contiguous with said open bottom; a spindle, predominately threaded to mate with the threads of said threaded opening so as to ascend and descend within said housing when turned clockwise and counterclockwise, respectively, said spindle having a distal end and a hexagonally-shaped proximal end; and, a claw assembly attached to said distal end of said spindle so as to allow said spindle to turn freely while said assembly is prevented by confinement within said housing wherein said claw assembly is sized to prevent rotation, said assembly having a claw formed by a cleft in said assembly said cleft capable of engaging with an exposed nail head and shank, said method steps comprising:

attaching the proximal end of said spindle of said extractor to a powered tool capable of receiving and securely retaining the hexagonally-shaped end of said spindle;

inserting the exposed nail head and shank within the cleft of said claw assembly so that the claw grasps the head of said nail; and, activating said powered tool to rotate said threaded spindle counter-clockwise whereby said threaded spindle and the freely attached claw assembly are vertically elevated within said housing and said inserted nail is extracted from said substrate.

* * * * *